US007551052B2

(12) United States Patent
Jow et al.

(10) Patent No.: US 7,551,052 B2
(45) Date of Patent: Jun. 23, 2009

(54) EMBEDDED INDUCTOR DEVICES AND FABRICATION METHODS THEREOF

(75) Inventors: Uei-Ming Jow, Taichung (TW); Chang-Sheng Chen, Taipei (TW); Chin-Sun Shyu, Pingtung Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/871,896

(22) Filed: Oct. 12, 2007

(65) Prior Publication Data

US 2008/0136574 A1 Jun. 12, 2008

(30) Foreign Application Priority Data

Dec. 11, 2006 (TW) ..... 95146229 A

(51) Int. Cl.
*H01F 27/36* (2006.01)

(52) U.S. Cl. ..... 336/84 M

(58) Field of Classification Search ..... 336/65, 336/83, 84 R, 84 M, 200, 232; 257/531
See application file for complete search history.

(56) References Cited

U.S. PATENT DOCUMENTS 5,329,020 A 7/1994 Kalota et al.
6,429,763 B1 8/2002 Patel et al.
6,593,838 B2 * 7/2003 Yue ..... 336/84 C
6,593,841 B1 * 7/2003 Mizoguchi et al. ..... 336/200
7,323,948 B2 * 1/2008 Ding et al. ..... 331/181

FOREIGN PATENT DOCUMENTS

| | | |
|---|---|---|
| JP | 2002324962 | 11/2002 |
| JP | 2006190934 | 7/2006 |
| TW | 518616 | 1/2003 |
| TW | I245592 | 12/2005 |

OTHER PUBLICATIONS

C. Patrick Yue et al, "On-Chip Spiral Inductors with Patterned Ground Shields for Si-Based RF IC's," 1997 Symposium on VLSI Circuits Digest of Technical Papers, p. 85-86, US, 1997.
Egidio Ragonese et al, "Experimental Comparison of Substrate Structures for Inductors and Transformers," IEEE MELECON 2004, p. 143-146, US, 2004.

* cited by examiner

*Primary Examiner*—Tuyen T. Nguyen
(74) *Attorney, Agent, or Firm*—Quintero Law Office

(57) ABSTRACT

Embedded inductor devices and fabrication methods thereof. An embedded inductor device includes a substrate, a conductive coil disposed on the substrate, and a patterned high-permeability ($\mu_r$>1) magnetic layer on the substrate. The patterned high-permeability ($\mu_r$>1) magnetic layer physically contacts the conductive coil. The conductive coil and the patterned high-permeability ($\mu_r$>1) magnetic layer are intersected and substantially perpendicular to each other.

15 Claims, 16 Drawing Sheets

EMBEDDED INDUCTOR DEVICES AND FABRICATION METHODS THEREOF

BACKGROUND OF THE INVENTION

1. Field of the Invention

The invention relates to embedded inductor devices, and in particular to embedded inductor devices with patterned high permeability magnetic layer to enhance inductance and electrical properties.

2. Description of the Related Art

Both passive and active electronic devices in circuits have been developed towards technique regimes such as high frequency, broad band, and miniaturization, and are applicable to a variety of electronic and communication devices including telecommunication, digital computers, and portable appliances. Embedding of electronic devices into the substrate has become a main developing trend to reduce circuit area. More particularly, embedded passive devices such as embedded inductors have been replacing conventional surface mounted technique (SMT) passive devices.

More fabrication steps and materials, however, are needed to realize the embedding of passive devices into a substrate. Some parasitic effects are generated due to the embedding of inductor devices, reducing electrical performance. For example, when inductor devices are embedded into a substrate, both inductance and quality factor of the inductor device are reduced by the loss of the substrate. Thus, embedded inductor devices with higher inductance are needed to meet requirements of a state of the art electronic circuit. Conventionally, inductance, quality factor and self-resonance frequency (SRF) of an embedded inductor device must be considered as designation of electronic circuit.

U.S. Pat. No. 5,329,020, the entirety of which is hereby incorporated by reference discloses a transformer configured with magnetic material to improve performance. A bulk magnetic material is introduced into an inductor coil of a conventional transformer to increase inductance thereof and improve performance. Conventional transfer using bulk magnetic material with high permeability (high-$\mu_r$) is very difficult to integrate into integrated passive devices (IPDs) and fabrication processes of circuit board.

U.S. Pat. No. 6,429,763, the entirety of which is hereby incorporated by reference discloses an integrated passive device circuit board with inductor devices on a magnetic substrate. Although configuring inductor devices on a magnetic substrate can improve inductor characteristics, the magnetic substrate causes coupling between the inductor device and other devices, resulting in parasitic effect deteriorating quality factor of the integrated passive device at high frequencies.

In an article entitled "On-Chip Spiral Inductors with Patterned Ground Shields for Si-Based RF IC's," IEEE 1997 Symposium on VLSI Circuits Digest of Technical Papers, the authors disclose disposal of a patterned ground integrated in planar inductor devices on a silicon substrate. The patterned ground is perpendicular to the winding of the planar inductor devices to improve quality factor thereof. But the improvement of the inductance is limited due to material of the patterned ground.

Furthermore, in an article entitled "Experimental Comparison of Substrate Structures for Inductors and Transformers," IEEE MELECON 2004, May 12-15, 2004, Dubrovnik, Croatia, the authors disclose a polygonal planar inductor device corresponding to patterned ground. The patterned ground is perpendicular to the winding of the polygonal planar inductor device to improve quality factor thereof. But the improvement of the inductance is limited due to material of the patterned ground.

FIG. 1A is a cross-section of a conventional planar embedded inductor device. FIG. 1B is a planar view of a conventional planar embedded inductor device corresponding to FIG. 1A. Referring to FIG. 1A, a planar embedded inductor device 1 includes a substrate 10 and a conductive coil 20 disposed on the substrate 10. A conductive layer 30 is disposed on the back of the substrate 10, and electrically connects the conductive coil 20 through a via hole 12 or contact plug. The conductive layer 30 typically serves as a ground of the conductive coil 20. Overall disposition of the ground results in inducing currents generating parasitic capacitor between the conductive coil 20 and ground. Thus, the improvement of quality factor is limited thereto.

FIG. 1C is a planar view of another conventional planar embedded inductor device. The conductive layer 30 on the back of the substrate 10 is patterned, and electrically connects the conductive coil 20 through a via hole 12 or contact plug. The patterned conductive layer 30 typically serves as a ground of the conductive coil 20. The patterned conductive layer 30 and the conductive coil 20 are separately disposed on both sides of the substrate 10, and are substantially perpendicular to each other at any crossover, thus improving the quality factor. The inductance of the conventional planar embedded inductor device is, however, limited.

FIG. 2A is schematic view of a conventional planar embedded inductor device. The planar embedded inductor device comprises a substrate 40 and a magnetic layer 42 with high permeability ($\mu_r$>1) disposed on the substrate 40. Note that the magnetic layer 42 is not patterned. A conductive coil 41 is disposed on the magnetic layer 42 with high permeability ($\mu_r$>1). The substrate 40 includes polymer substrate or ceramic substrate. The conductive coil 41 electrically connects a conductive layer 46 on the back of the substrate 40 through a via hole 46 or contact plug, thereby generating a loop. The conductive coil 41 includes a square coil or a rectangular coil, wherein the conductive coil 41 includes 3 turns, the width of the conductive coil is 20 mil, and the interval therebetween is 20 mil.

FIG. 2B is schematic view of another conventional planar embedded inductor device. The planar embedded inductor device comprises a substrate 50 and a magnetic layer 52 with high permeability ($\mu_r$>1) disposed on the substrate 50. Note that the magnetic layer 52 is not patterned. A conductive coil 51 is disposed on the magnetic layer 52 with high permeability ($\mu_r$>1). The conductive coil 51 electrically connects a conductive layer 56 on the back of the substrate 50 through a via hole 56 or contact plug, thereby generating a loop. The conductive coil 51 includes a circular coil, wherein the conductive coil 51 includes 3 turns, the width of the conductive coil is 20 mil, and the interval therebetween is 20 mil. Although the inductance (L) of the convention planar embedded inductor devices can increase using a magnetic layer 52 with high permeability ($\mu_r$>1), however, the conventional method does not noticeably improve the quality factor.

BRIEF SUMMARY OF THE INVENTION

Accordingly, planar embedded inductor devices with high inductance as well as high quality factor are provided. The patterned magnetic layer with high permeability ($\mu_r$>1) directly contacts the conductive coil of the embedded inductor device to improve inductance and the quality factor at high frequency application.

An embodiment of the invention provides an embedded inductor device, comprising a substrate, a conductive coil disposed on the substrate, and a patterned magnetic layer with high permeability disposed on the substrate, wherein the patterned magnetic layer physically contacts the conductive coil, wherein the conductive coil and the patterned magnetic layer are intersected and substantially perpendicular to each other.

Another embodiment of the invention further provides a method for fabricating an embedded inductor device. A substrate is provided. A conductive coil is formed on the substrate. A first patterned magnetic layer with high permeability is formed on the substrate, wherein the patterned magnetic layer physically contacts the conductive coil, wherein the conductive coil and the patterned magnetic layer intersect and are substantially perpendicular to each other.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

The invention is directed to applying a patterned magnetic layer with high permeability ($\mu_r$>1) on an embedded inductor device to enhance inductance and quality factor as well as self-resonate frequency (SRF). More specifically, the patterned magnetic layer is substantially perpendicular to the conductive coil of the embedded inductor device at any crossover. The magnetic field generated by the conductive coil is parallel to the inducing current generated in the patterned magnetic layer to enhance the magnetic field and reducing parasitic effect and magnetic hysteresis loss. The embedded inductor device can thus maintain high inductance, high quality factor and high self-resonate frequency at high frequency application.

Figure 3:
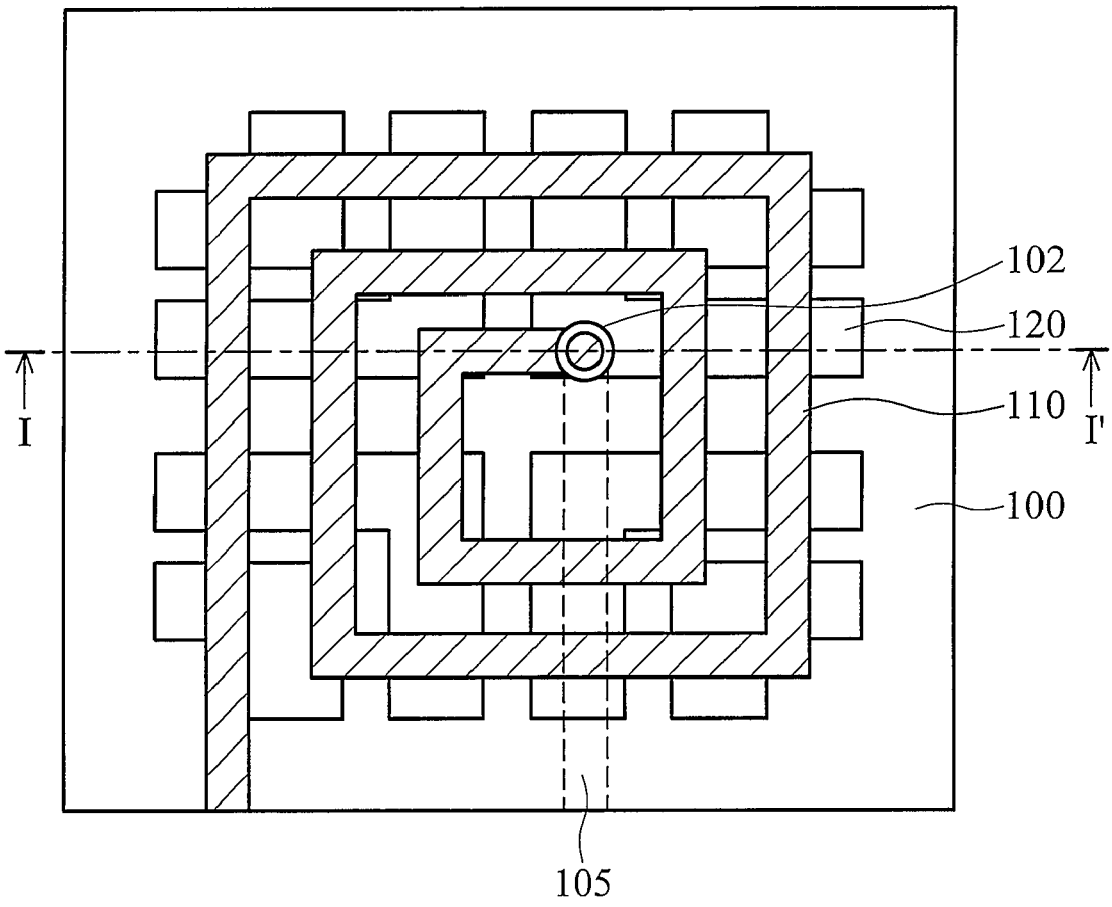
FIG. 3 is a plan view of an exemplary embodiment of an embedded inductor device of the invention.

FIG. 3 is a plan view of an exemplary embodiment of an embedded inductor device of the invention. In FIG. 3, a magnetic layer 120 with high permeability ($\mu_r$>1) on a substrate 100 is patterned such that the patterned magnetic layer is substantially perpendicular to the conductive coil 110 at any crossover. The conductive coil 110 perforates the substrate 100 and connects a conductive layer 105 on the back of the substrate via a contact plug 102 or via hole, thereby generating a loop. Note that the magnetic layer 120 with high permeability ($\mu_r$>1) can be disposed above the conductive coil 110 or alternatively under the conductive coil 110.

Figure 4A:
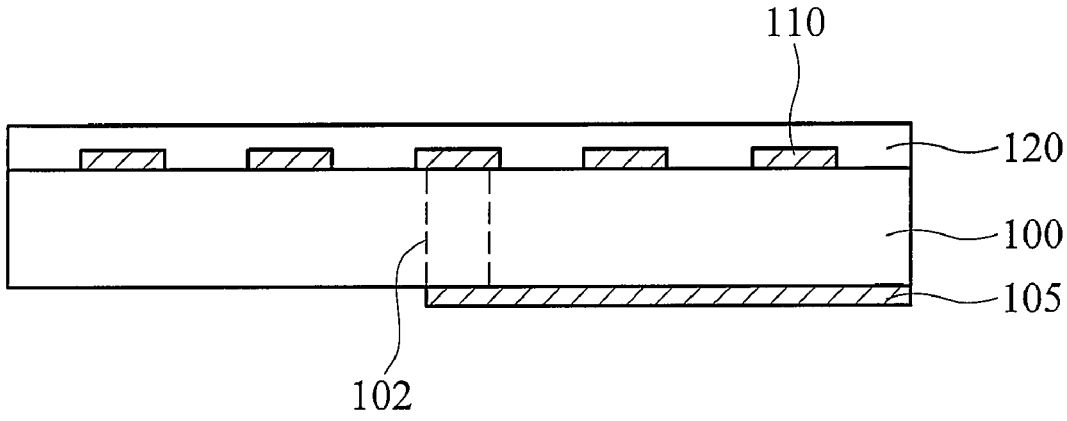
FIG. 4A is a cross section of an embodiment of an embedded inductor device of the invention taken along line I-I' of FIG. 3.

FIG. 4A is a cross section of an embodiment of an embedded inductor device of the invention taken along line I-I' of FIG. 3. Referring to FIG. 4A, a planar or three dimensional embedded inductor device comprises a substrate 100 and a conductive coil 110 disposed thereon. The substrate 100 can be a polymer substrate or a ceramic substrate. The conductive coil 110 can perforate the substrate 100 and connect a conductive layer 105 on the back of the substrate via a contact plug 102 or via hole, thereby generating a loop. The conductive layer can be a ground plane or ground traces. A magnetic layer 120 with high permeability ($\mu_r$>1) is applied or deposited on the substrate 100 and directly contacts the conductive coil. According to an embodiment of the invention, the magnetic layer 120 with high permeability ($\mu_r$>1) is patterned such that the patterned magnetic layer 120 is substantially perpendicular to the conductive coil 110 at any crossover.

The conductive coil 110 can comprise metal, preferably a copper layer. A metal layer is formed by electric chemical plating (ECP), electroless plating, pressing, or attaching on the substrate 100. The metal layer is then lithographically etched and patterned into conductive coil. Alternatively, the conductive coil 110 can be directly formed by thick film coating, screen printing, or inkjet printing. More specifically, a slurry containing conductive components is coated by anastatic printing or screen printing on the substrate, and then fired or sintered into the conductive coil 110.

The magnetic layer 120 with high permeability ($\mu_r$>1) comprises any magnetic material with relative permeability ($\mu_r$) exceeding 1 such as ferrite magnetic material. The magnetic layer 120 can be formed by overall deposition, pressing, or attaching on the substrate 100 and covering the conductive coil 110. According to an embodiment of the invention, the magnetic layer 120 can be further lithographically etched and patterned such that the patterned magnetic layer 120 is substantially perpendicular to the conductive coil 110 at any crossover. Alternatively, the patterned magnetic layer 120 can be directly formed by thick film coating, screen printing, or inkjet printing. More specifically, a slurry containing high permeability ($\mu_r$>1) components is coated by anastatic printing or screen printing on the substrate 100, and then fired or sintered into the patterned magnetic layer 120.

Since the induced magnetic field generated by the conductive coil is parallel to the patterned magnetic layer, the distribution of the induced magnetic flux is more concentrated to enhance inductance of the embedded inductor device. Moreover, at the winding corner of the conductive coil, the magnetic layer with high permeability ($\mu_r$) can reduce magnetic hysteresis loss, thereby maintaining high quality factor and high self-resonate frequency at high frequency application.

Figure 4B:
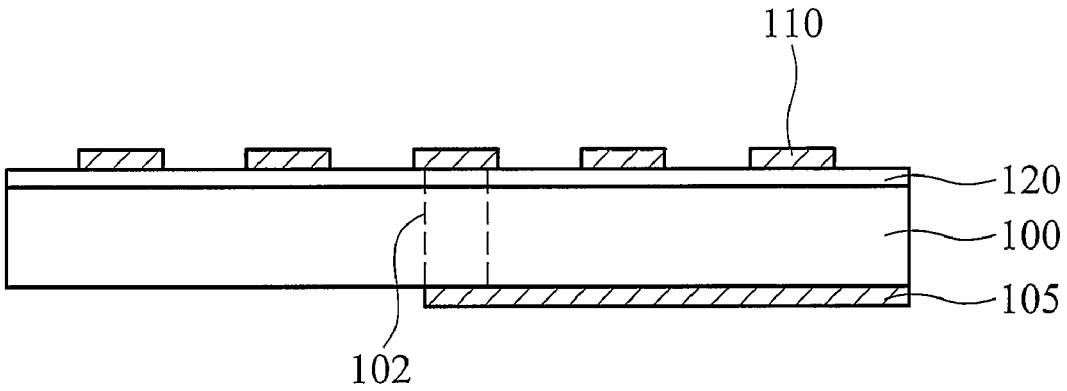
FIG. 4B is a cross section of another embodiment of an embedded inductor device of the invention.

FIG. 4B is a cross section of another embodiment of an embedded inductor device of the invention. Referring to FIG. 4B, another exemplary embodiment of a planar or three dimensional embedded inductor device comprises a substrate 100 and a magnetic layer 120 with high permeability ($\mu_r$>1) disposed thereon. For example, a patterned magnetic layer 120 with high permeability ($\mu_r$>1) can be formed by thick-film coating, screen printing or inkjet printing. More specifically, a slurry containing high permeability ($\mu_r$>1) components is coated by anastatic printing or screen printing on the substrate 100, and then fired or sintered into the patterned magnetic layer 120.

A conductive coil 110 is formed on the patterned magnetic layer 120 with high permeability ($\mu_r$>1). The conductive coil 110 can perforate the substrate 100 and connect a conductive layer 105 on the back of the substrate via a contact plug 102 or via hole, thereby generating a loop. The conductive layer can be a ground plane or ground traces. The conduct coil 110 directly contacts the magnetic layer 120 with high permeability ($\mu_r$>1). According to an embodiment of the invention, the magnetic layer 120 with high permeability ($\mu_r$>1) is patterned such that the patterned magnetic layer 120 is substantially perpendicular to the conductive coil 110 at any crossover. The magnetic layer 120 with high permeability ($\mu_r$>1) comprises any magnetic material with relative permeability ($\mu_r$) exceeding 1 such ferrite magnetic material.

The conductive coil 110 can comprise metal, preferably a copper layer. A metal layer is formed by electric chemical plating (ECP), electroless plating, pressing, or attaching on the substrate 100. The metal layer is then lithographically etched and patterned into conductive coil 110. Alternatively, the conductive coil 110 can be directly formed by thick film coating, screen printing, or inkjet printing. More specifically, a slurry containing conductive components is coated by anastatic printing or screen printing on the substrate, and then fired or sintered into the conductive coil 110.

Since the induced magnetic field generated by the conductive coil is parallel to the patterned magnetic layer, the distribution of the induced magnetic flux is more concentrated to enhance inductance of the embedded inductor device. Moreover, at the winding corner of the conductive coil, the magnetic layer with high permeability ($\mu_r$) can reduce magnetic hysteresis loss, thereby maintaining high quality factor and high self-resonate frequency at high frequency application.

Figure 4C:
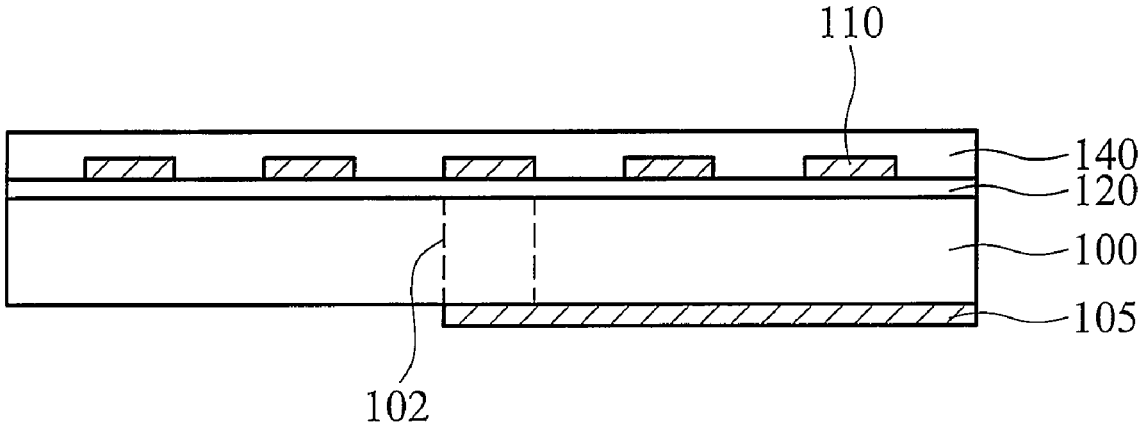
FIG. 4C is a cross section of another embodiment of an embedded inductor device of the invention.

FIG. 4C is a cross section of another embodiment of an embedded inductor device of the invention. Compared with the embodiment of FIG. 4B, the inductor device of the embodiment of FIG. 4C further comprises another magnetic layer 140 with high permeability ($\mu_r$>1) disposed on the magnetic layer 120 and directly contacts the conductive coil 110. The conductive coil 110 is interposed between the patterned magnetic layers with high permeability ($\mu_r$>1) 120 and 140. The patterned magnetic layers with high permeability ($\mu_r$>1) 120 and 140 can comprise the same identical patterns. Furthermore, the patterned magnetic layers with high permeability ($\mu_r$>1) 120 and 140 and the conductive coil 110 are substantially perpendicular to each other at any crossover.

Figure 4D:
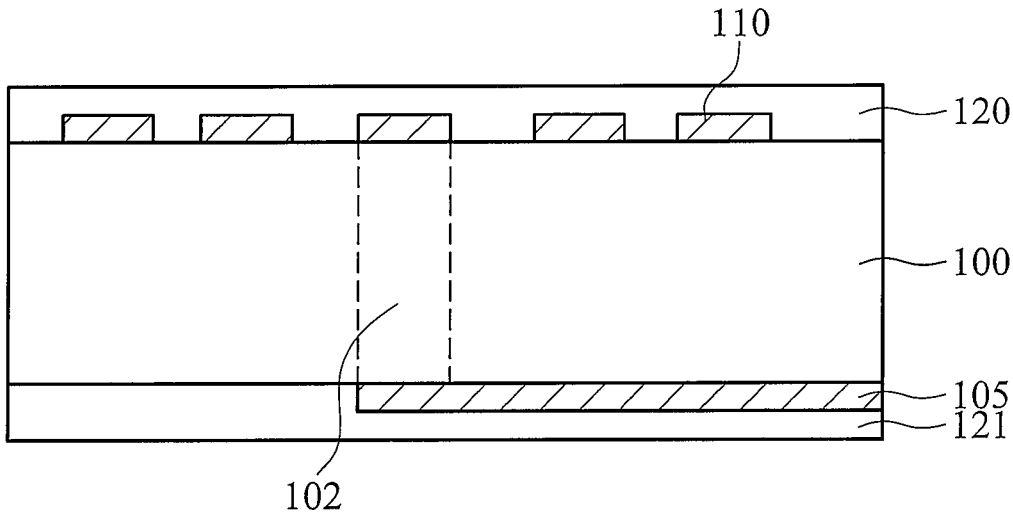
FIG. 4D is a cross section of another embodiment of an embedded inductor device of the invention.

FIG. 4D is a cross section of another embodiment of an embedded inductor device of the invention. Compared with the embodiment of FIG. 4A, the inductor device of the embodiment of FIG. 4D further comprises another magnetic layer 121 with high permeability ($\mu_r$>1) disposed on the back of the substrate 100 and covering conductive layer 105 or the conductive coil. The magnetic layer 121 with high permeability ($\mu_r$>1) can be patterned such that the patterned magnetic layer 121 with high permeability ($\mu_r$>1) is substantially perpendicular to the conductive coil 110 or 105 at any crossover.

Figure 4E:
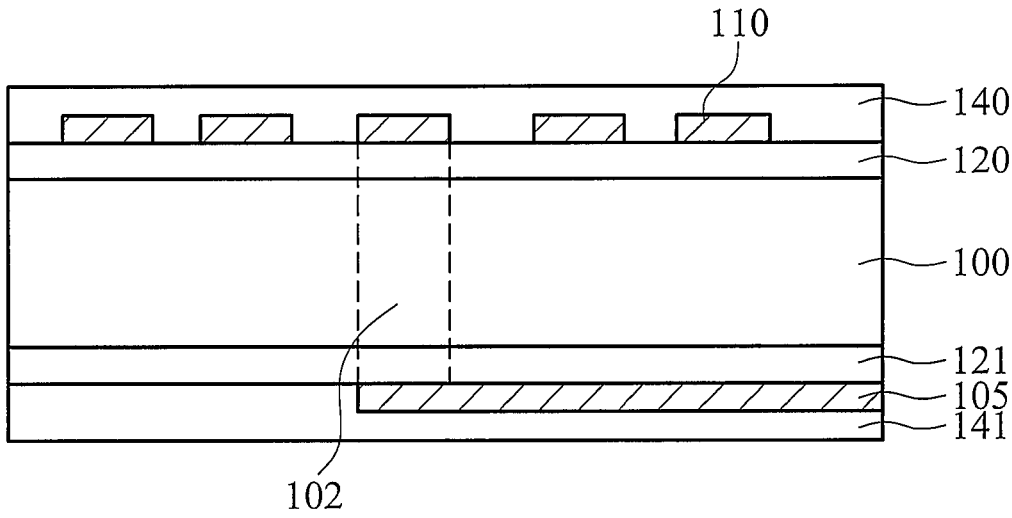
FIG. 4E is a cross section of further another embodiment of an embedded inductor device of the invention.

FIG. 4E is a cross section of further another embodiment of an embedded inductor device of the invention. Compared with the embodiment of FIG. 4C, the inductor device of the embodiment of FIG. 4E further comprises a magnetic layer 121 with high permeability ($\mu_r$>1) disposed on the back of the substrate 100. The conductive layer 105 or the conductive coil is disposed on the magnetic layer 121 with high permeability ($\mu_r$>1). A magnetic layer 141 with high permeability ($\mu_r$>1) disposed on the magnetic layer 121 directly contacts the conductive coil 105. The conductive coil 105 is interposed between the patterned magnetic layers with high permeability ($\mu_r$>1) 121 and 141. The patterned magnetic layers with high permeability ($\mu_r$>1) 121 and 141 can comprise the same identical patterns. Furthermore, the patterned magnetic layers with high permeability ($\mu_r$>1) 121 and 141 and the conductive coil 110 or 105 are substantially perpendicular to each other at any crossover.

Figure 5A:
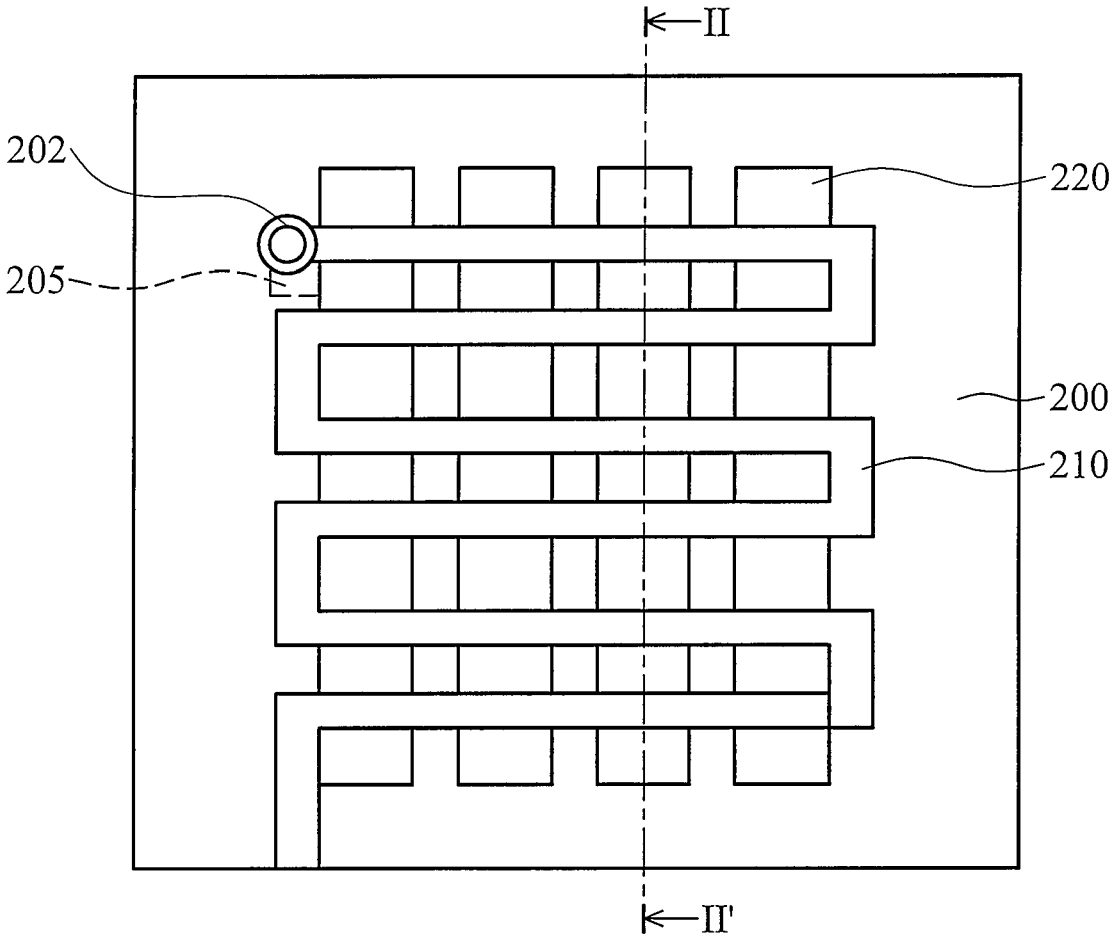
FIG. 5A is a plan view of another exemplary embodiment of an embedded inductor device of the invention.

FIG. 5A is a plan view of another exemplary embodiment of an embedded inductor device of the invention. Referring to FIG. 5A, a magnetic layer with high permeability ($\mu_r$>1) 220 is patterned on a substrate 200, wherein a conductive coil 210 is substantially perpendicular to the patterned magnetic layer 220 with high permeability ($\mu_r$>1) at any crossover. The conductive coil 210 is a meander winding or a serpentine winding disposed on the substrate 200 and connects a conductive layer 205 on the back of the substrate 200 via a contact plug 202 or via hole, thereby generating a loop. Note that the magnetic layer 220 with high permeability ($\mu_r$>1) can be disposed above the conductive coil 210 or alternatively under the conductive coil 210.

Figure 5B:
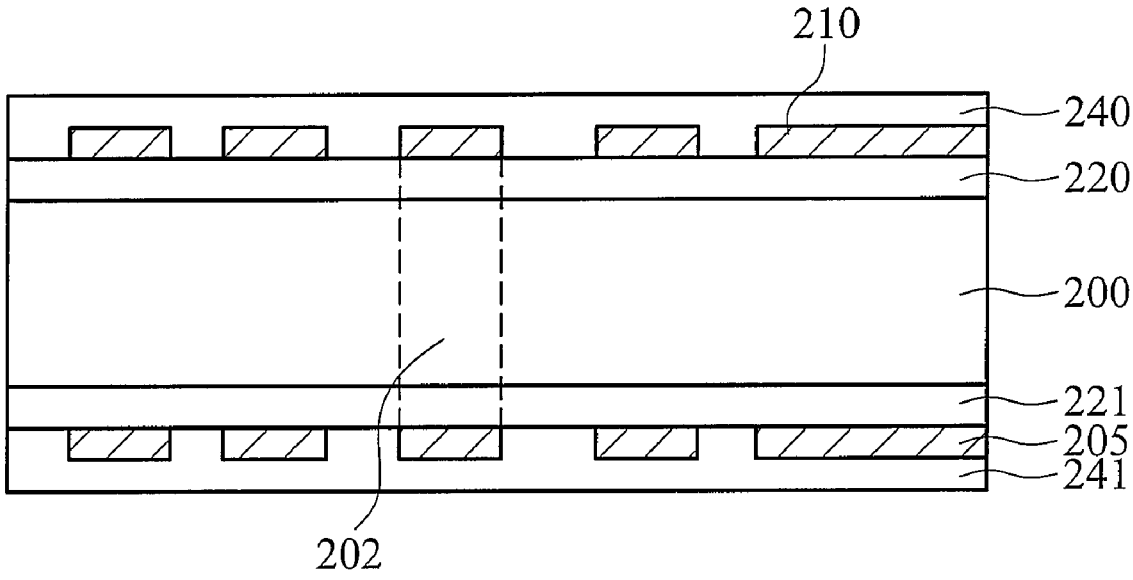
FIG. 5B is a cross section of an embodiment of an embedded inductor device of the invention taken along line II-II' of FIG. 5A.

FIG. 5B is a cross section of an embodiment of an embedded inductor device of the invention taken along line II-II' of FIG. 5A. Referring to FIG. 5B, a planar or three dimensional embedded inductor device comprises a substrate 200 and a magnetic layer 220 with high permeability ($\mu_r$>1) disposed thereon. A conductive coil 210 is disposed on the magnetic layer 220. The conductive coil 210 can perforate the substrate 200 and connect a conductive layer 205 on the back of the substrate 200 via a contact plug 202 or via hole, thereby generating a loop. Moreover, a patterned magnetic layer 240 with high permeability ($\mu_r$>1) is disposed on the magnetic layer 220 with high permeability ($\mu_r$>1) and directly contacts the conductive coil 210. The conductive coil 210 is interposed between the patterned magnetic layers with high permeability ($\mu_r$>1) 220 and 240. The patterned magnetic layers with high permeability ($\mu_r$>1) 220 and 240 can comprise the same identical patterns. Furthermore, the patterned magnetic layers with high permeability ($\mu_r$>1) 220 and 240 and the conductive coil 210 are substantially perpendicular to each other at any crossover.

Furthermore, a magnetic layer 221 with high permeability ($\mu_r$>1) is disposed on the back of the substrate 200. A conductive layer 205 or the conductive coil is disposed on the magnetic layer 221 with high permeability ($\mu_r$>1). A magnetic layer 241 with high permeability ($\mu_r$>1) disposed on the magnetic layer 221 directly contacts the conductive coil 205. The conductive coil 205 is interposed between the patterned magnetic layers 221 and 241. The patterned magnetic layers 221 and 241 can comprise the same identical patterns. Furthermore, the patterned magnetic layers 221 and 241 and the conductive coil 205 are substantially perpendicular to each other at any crossover.

Figure 6A:
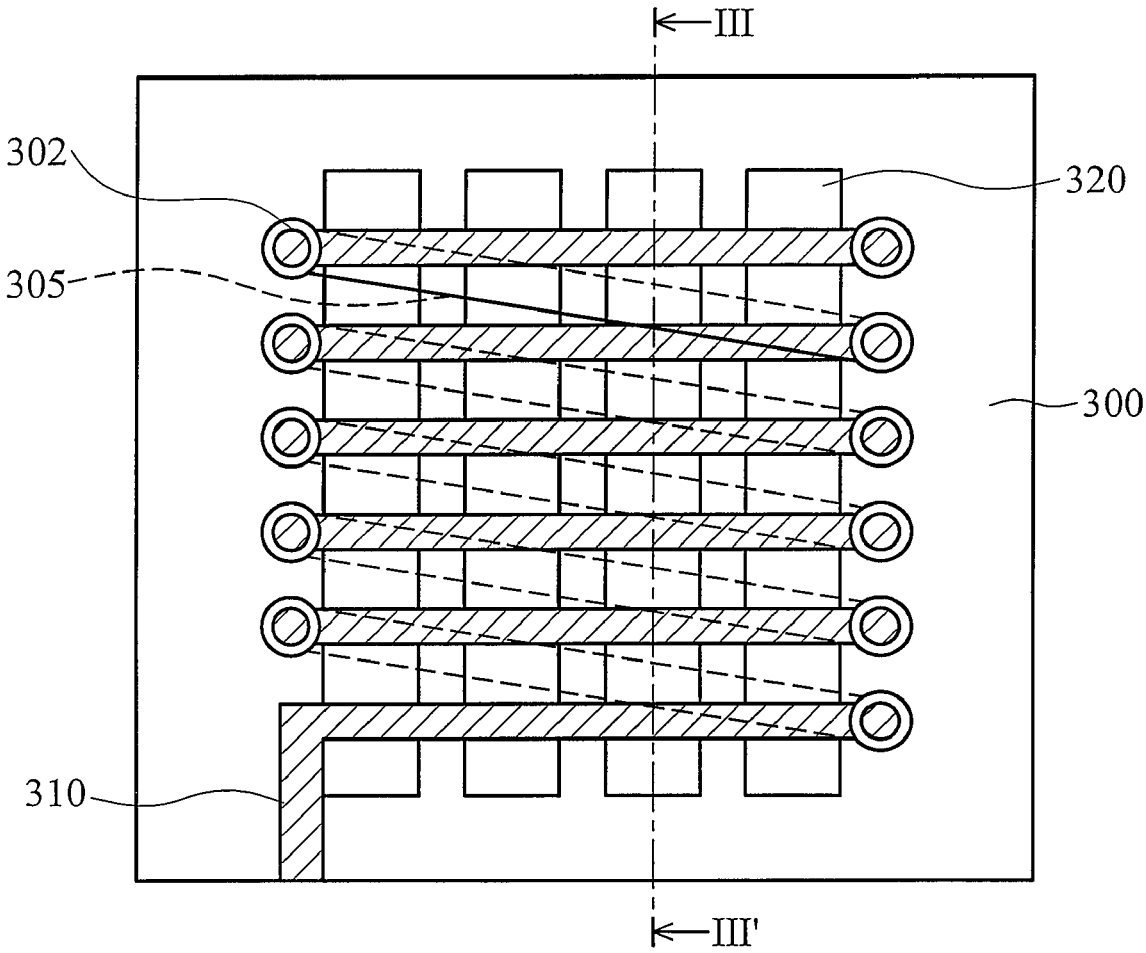
FIG. 6A is a plan view of another exemplary embodiment of an embedded inductor device of the invention.

FIG. 6A is a plan view of another exemplary embodiment of an embedded inductor device of the invention. Referring to FIG. 6A, a magnetic layers with high permeability ($\mu_r$>1) 320 is patterned on a substrate 300, wherein a conductive coil 310 is substantially perpendicular to the patterned magnetic layer 320 with high permeability ($\mu_r$>1) at any crossover. More specifically, the conductive coil 310 comprises a plurality of parallel conductive segments both ends of which connect to conductive segments 305 on the back of the substrate 300 via contact plugs 302 or via holes, thereby generating meander winding or serpentine winding solenoid in the substrate 300. Note that the patterned magnetic layer 320 with high permeability ($\mu_r$>1) can comprise parallel strip structures disposed above the conductive coil 310 or alternatively under the conductive coil 310.

Figure 6B:
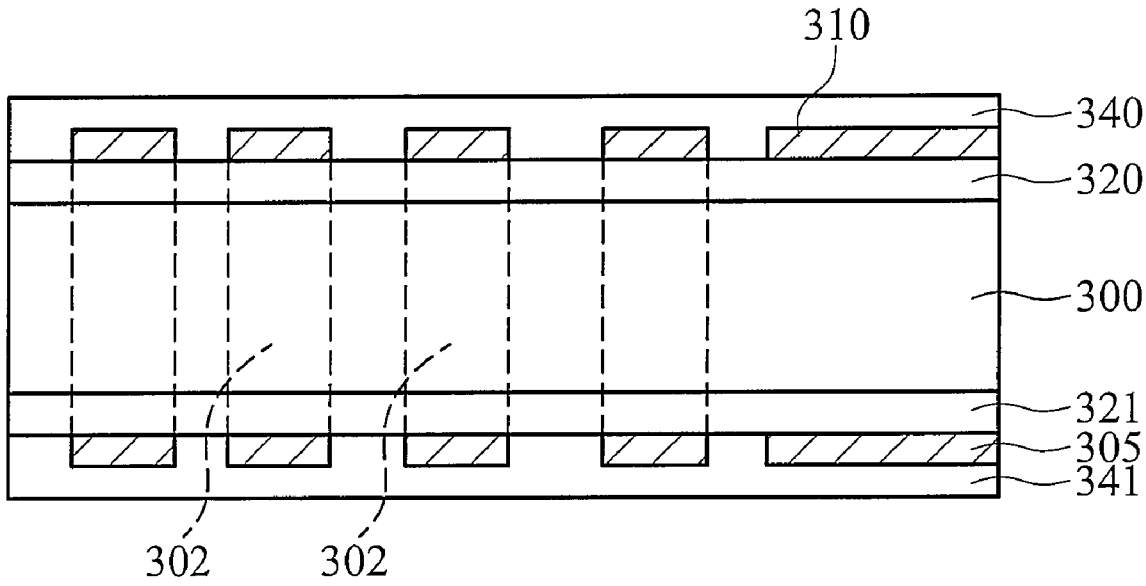
FIG. 6B is a cross section of an embodiment of an embedded inductor device of the invention taken along line III-III' of FIG. 6A.

FIG. 6B is a cross section of an embodiment of an embedded inductor device of the invention taken along line III-III' of FIG. 6A. Referring to FIG. 6B, a planar or three dimensional embedded inductor device comprises a substrate 300 and a magnetic layer 320 with high permeability ($\mu_r$>1) disposed thereon. A conductive coil 310 is disposed on the magnetic layer 320. The conductive coil 310 comprises a plurality of parallel conductive segments both ends of which connect conductive segments 305 on the back of the substrate 300 via contact plugs 302 or via holes, thereby generating meander winding or serpentine winding solenoid in the substrate 300. Moreover, a patterned magnetic layer 340 with high permeability ($\mu_r$>1) is disposed on the magnetic layer 320 with high permeability ($\mu_r$>1) and directly contacts the conductive coil 310. The conductive coil 310 is interposed between the patterned magnetic layers with high permeability ($\mu_r$>1) 320 and 340. The patterned magnetic layers with high permeability ($\mu_r$>1) 320 and 340 can comprise the same identical patterns. Furthermore, the patterned magnetic layers with high permeability ($\mu_r$>1) 320 and 340 and the conductive coil 310 are substantially perpendicular to each other at any crossover.

Furthermore, a magnetic layer 321 with high permeability ($\mu_r$>1) is disposed on the back of the substrate 300. A conductive layer 305 or the conductive coil is disposed on the magnetic layer 321 with high permeability ($\mu_r$>1). A magnetic layer 341 with high permeability ($\mu_r$>1) disposed on the magnetic layer 321 directly contacts the conductive coil 305. The conductive coil 305 is interposed between the patterned magnetic layers 321 and 341. The patterned magnetic layers 321 and 341 can comprise the same identical patterns. Furthermore, the patterned magnetic layers 321 and 341 and the conductive coil 305 are substantially perpendicular to each other at any crossover.

Figure 7:
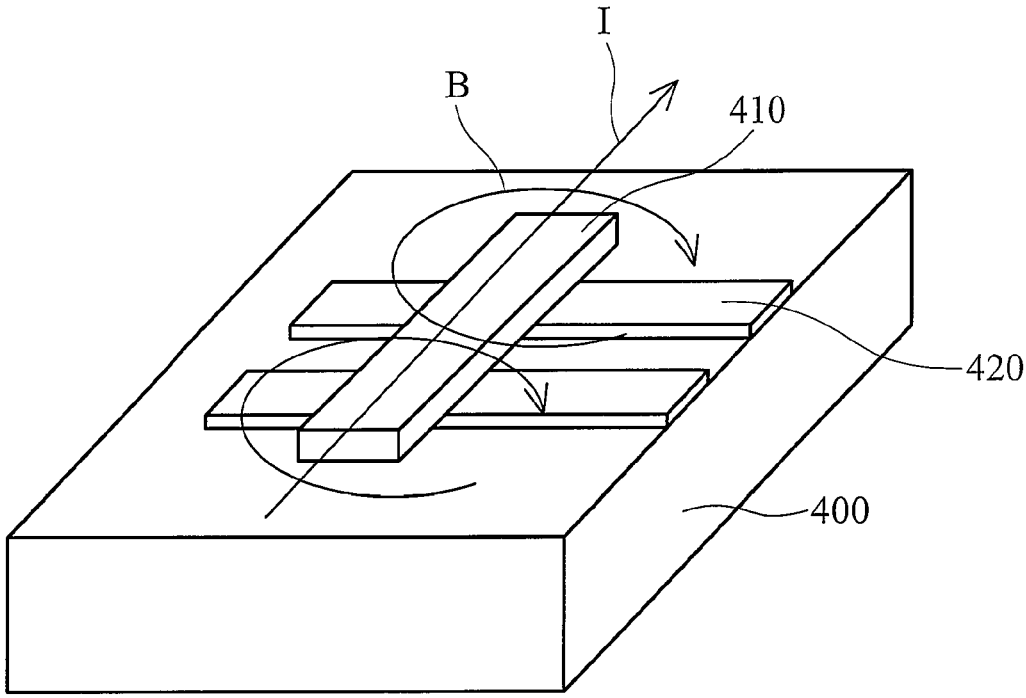
FIG. 7 is a schematic view of a local enlargement of an exemplary embedded inductor device in operation corresponding to FIG. 4B.

FIG. 7 is a schematic view of a local enlargement of an exemplary embedded inductor device in operation corresponding to FIG. 4B. In operation, when current I is conducted in the conductive coil 410, an induced magnetic field B is generated about the conductive coil 410. Since the patterned high-$\mu_r$ magnetic layer 420 and the conductive coil 410 are substantially perpendicular to each other at any crossover, the induced magnetic field B generated by the conductive coil 410 is parallel to the patterned magnetic layer 420. Furthermore, the distribution of the induced magnetic flux is more concentrated in the patterned magnetic layer 420 due to storage capability of magnetic energy of the patterned magnetic layer 420. Moreover, at the winding corner of the conductive coil 410, the magnetic layer 420 with high permeability ($\mu_r$) can reduce magnetic hysteresis loss, thereby maintaining high quality factor and high self-resonate frequency (SRF) at high frequency application.

Figure 1A:
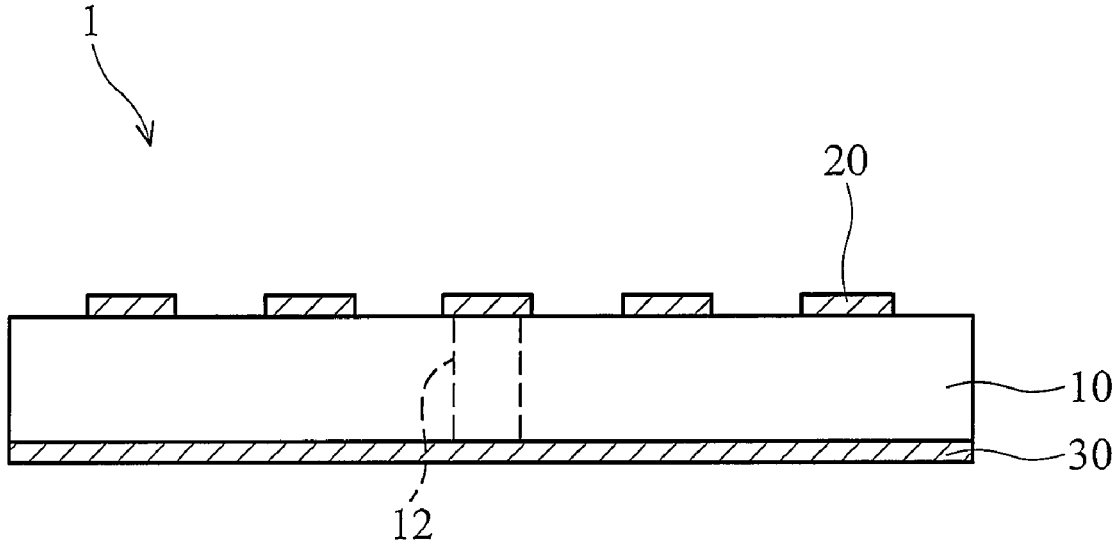
FIG. 1A (PRIOR ART)
FIG. 1A is a cross-section of a conventional planar embedded inductor device.
Figure 1B:
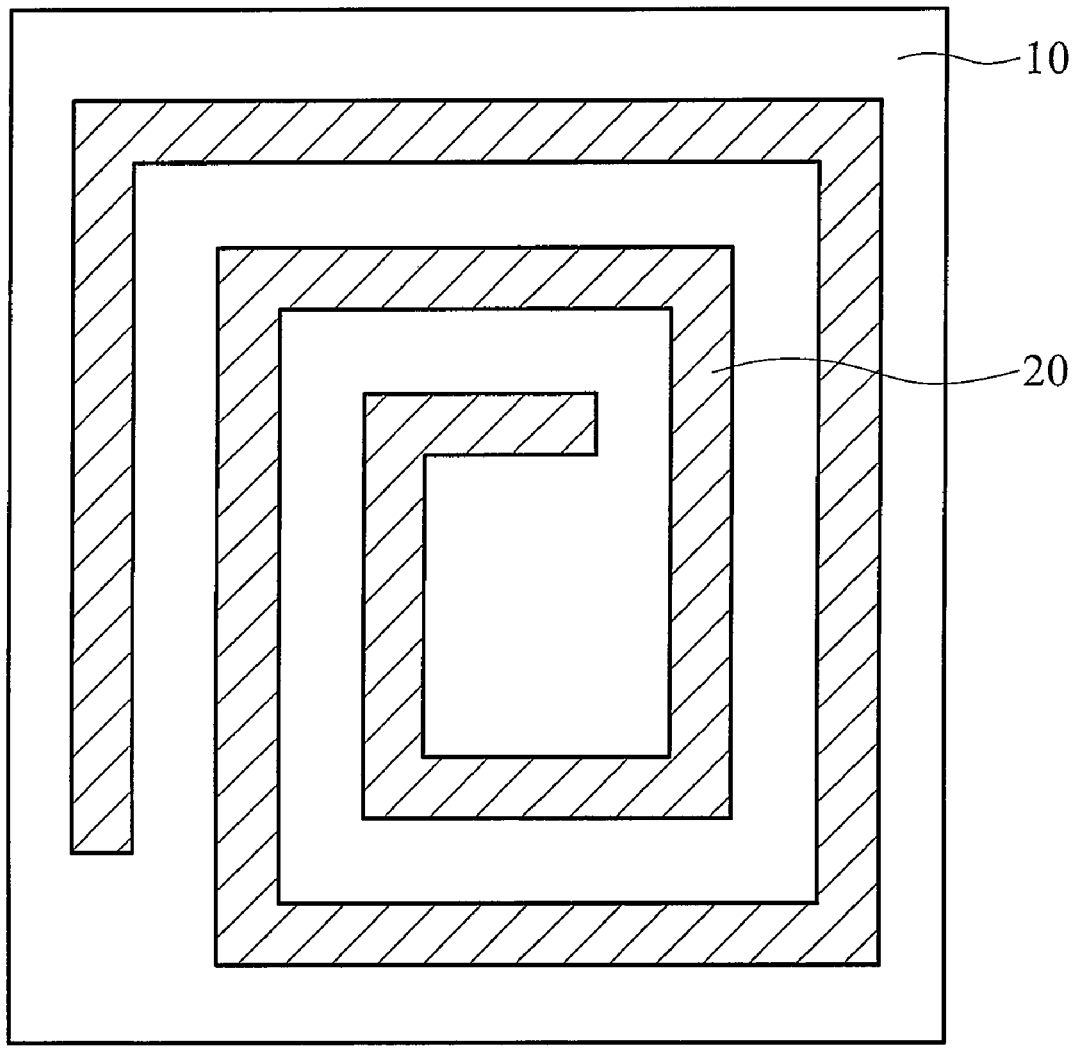
FIG. 1B (PRIOR ART)
FIG. 1B is a planar view of a conventional planar embedded inductor device corresponding to FIG. 1A.
Figure 1C:
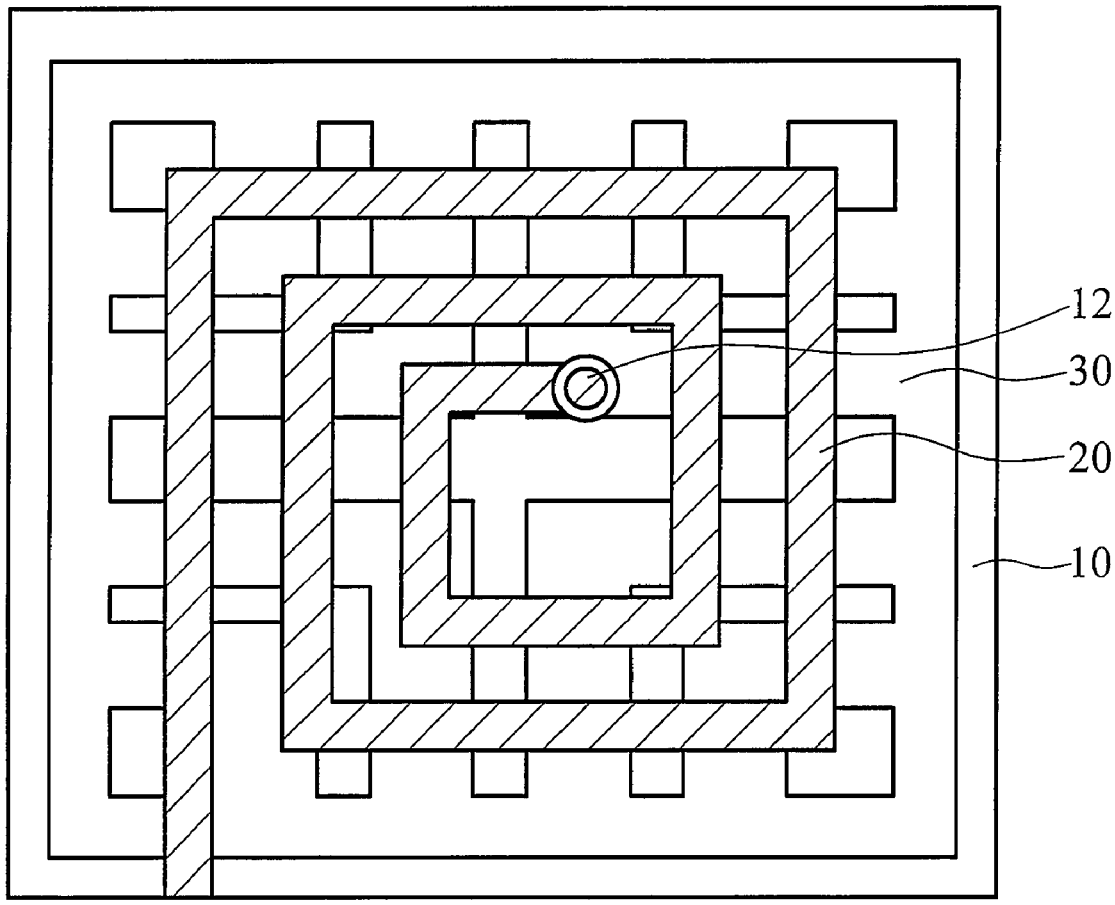
FIG. 1C (PRIOR ART)
FIG. 1C is a planar view of another conventional planar embedded inductor device.
Figure 2A:
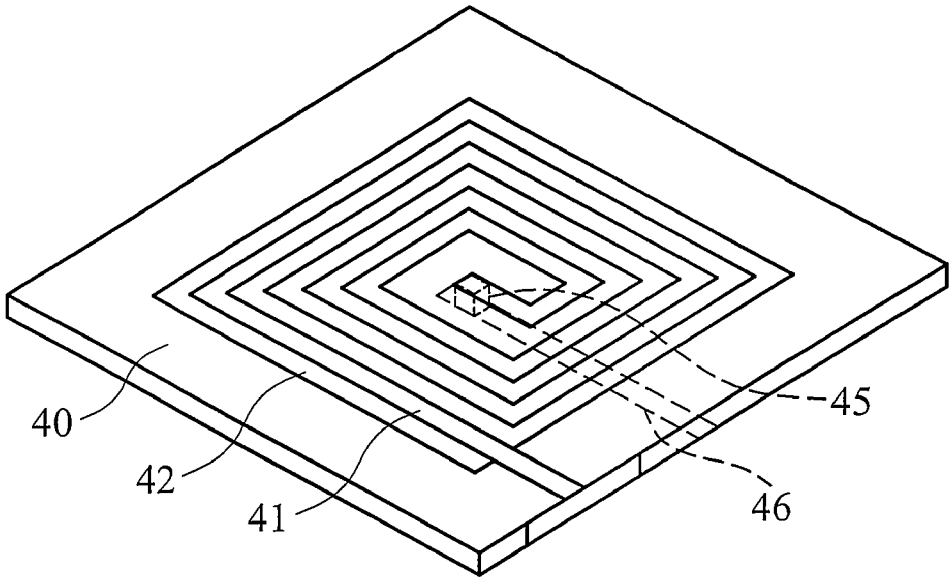
FIG. 2A (PRIOR ART)
FIG. 2A is schematic view of a conventional planar embedded inductor device.
Figure 2B:
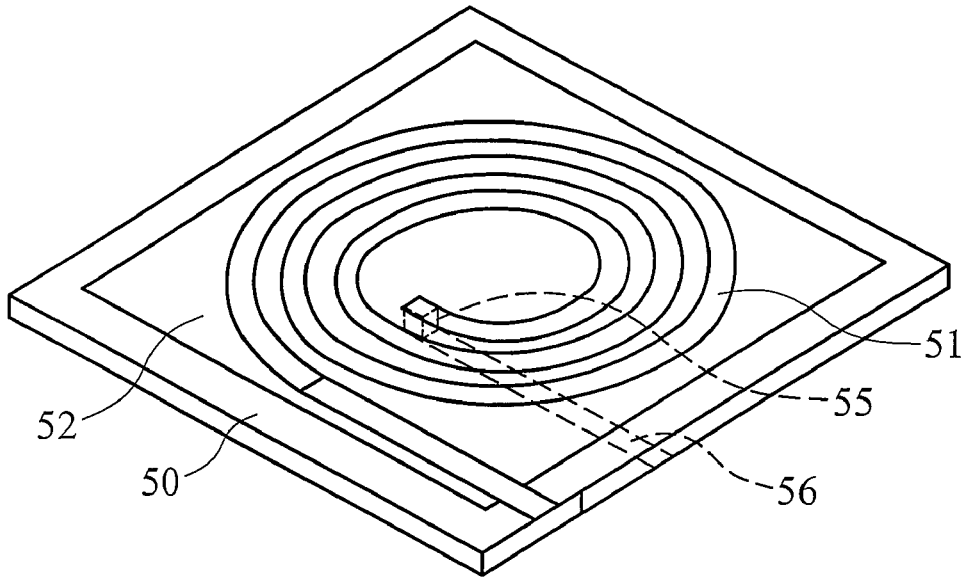
FIG. 2B (PRIOR ART)
FIG. 2B is schematic view of another conventional planar embedded inductor device.
Figure 8:
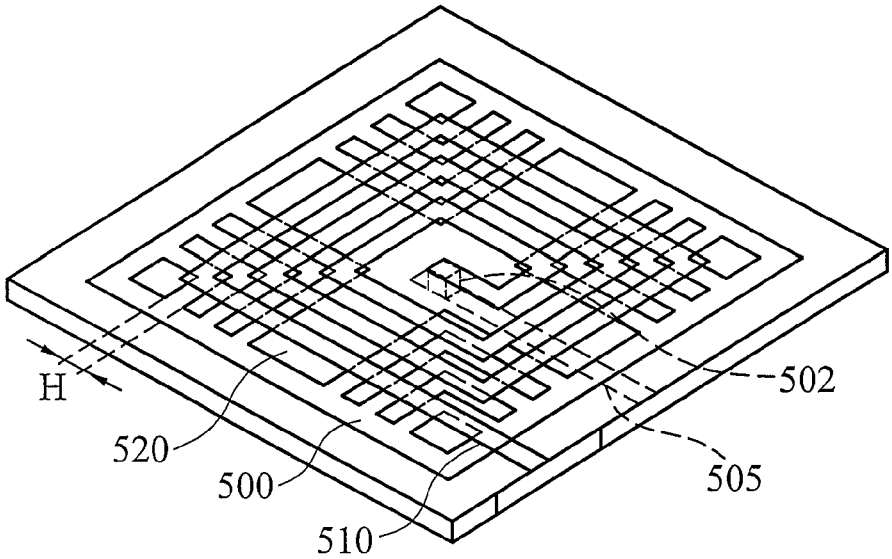
FIG. 8 is a schematic view of another embodiment of an embedded inductor device of the invention.

FIG. 8 is a schematic view of another embodiment of an embedded inductor device of the invention. The structure and fabrication steps of the embedded inductor device of FIG. 8 are nearly identical to those of the embedded inductor device of FIG. 8 and for simplicity their detailed description are omitted. The embedded inductor device of FIG. 8 is different from the embedded inductor device of FIG. 2 in that the magnetic layer 520 with high permeability ($\mu_r$) is patterned such that the patterned magnetic layer 520 is substantially perpendicular to the conductive coil 510 at any crossover. The conductive coil 510 can be a square coil or a rectangular coil. The winding of the conductive coil 510 includes at least 3 turns, the line width which is about 20 mil, and the line interval of which is about 20 mil. The line width of the patterned magnetic layer 520 is about 5-20 mil, and the line interval H of which is about 5-20 mil. If line interval H of the patterned magnetic layer 520 is lower, i.e., about 5 mil, higher inductance of the embedded inductor device can be achieved. The patterned magnetic layer 520 with high permeability ($\mu_r$) can significantly improve inductance of the embedded inductor device compared with conventional embedded inductor devices.

Note that when the line width of the patterned magnetic layer 520 is about 5-20 mil, and the line interval H of which is about 5-20 mil, the inductance of the embedded inductor device increases from 2.24 nH to 2.52 nH, and the ratio of improvement is 12.5%. Moreover, the quality factor of the embedded inductor device increases from 39 to 84, and the ratio of improvement is 115.2%. Accordingly, reducing the line width and line interval of the patterned magnetic layer 520 can significantly enhance inductance and quality factor of the embedded inductor device at high frequency application.

Figure 9:
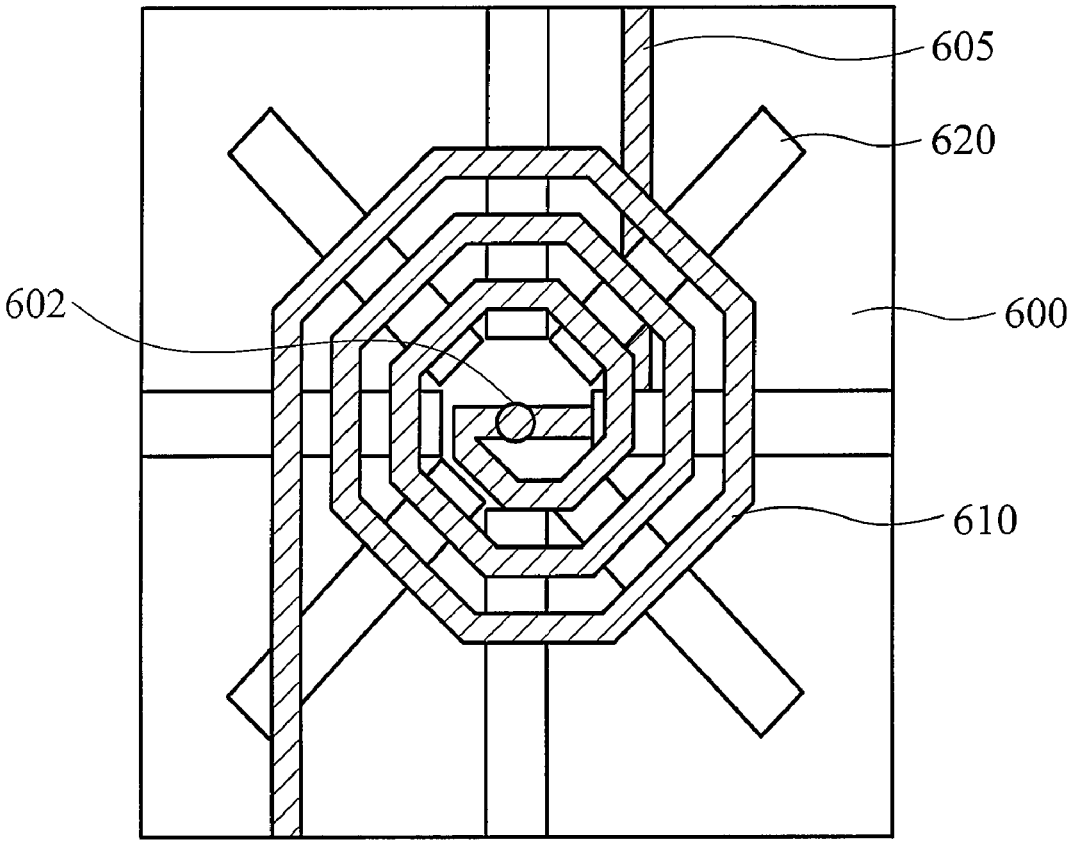
FIG. 9 is a schematic view of another embodiment of an embedded inductor device of the invention.

FIG. 9 is a schematic view of another embodiment of an embedded inductor device of the invention. The structure and fabrication steps of the embedded inductor device of FIG. 9 are nearly identical to those of the embedded inductor device of FIG. 8 and for simplicity their detailed description is omitted. The embedded inductor device of FIG. 9 is different from the embedded inductor device of FIG. 8 in that the conductive coil 610 is a polygonal coil comprising more than four sides such a hexagonal coil or a octagonal coil. The magnetic layer 620 with high permeability ($\mu_r$) is patterned such that the patterned magnetic layer 620 is substantially perpendicular to the conductive coil 610 at any crossover, thereby confining the induced magnetic flux along the patterned magnetic layer 620.

Figure 10A:
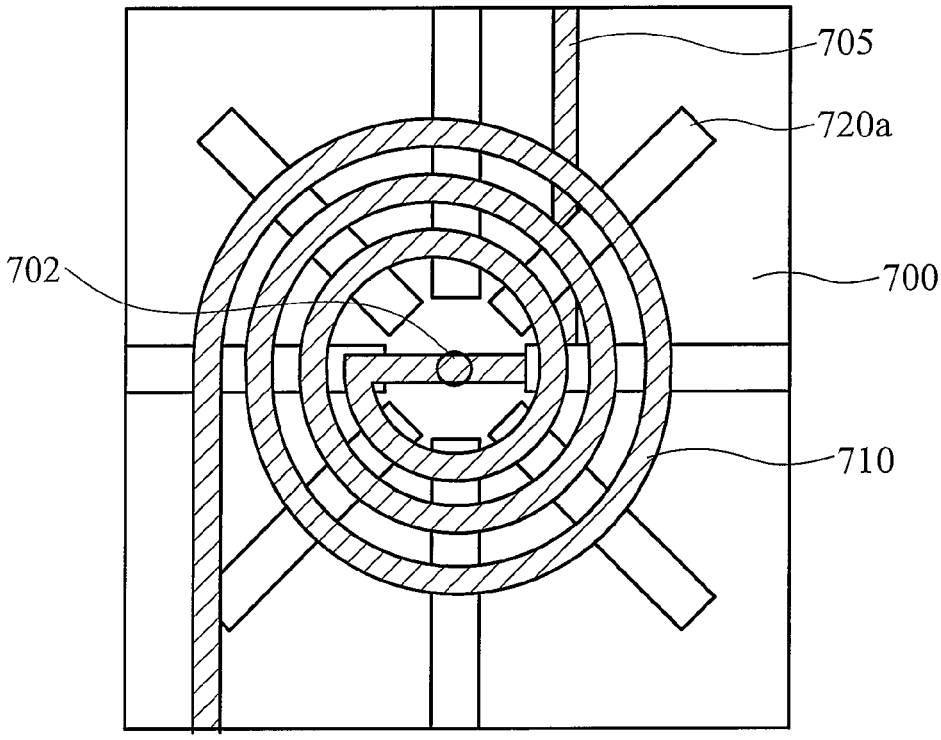
FIGS. 10A-10C are schematic views of another embodiment of embedded inductor devices of the invention.
Figure 10B:
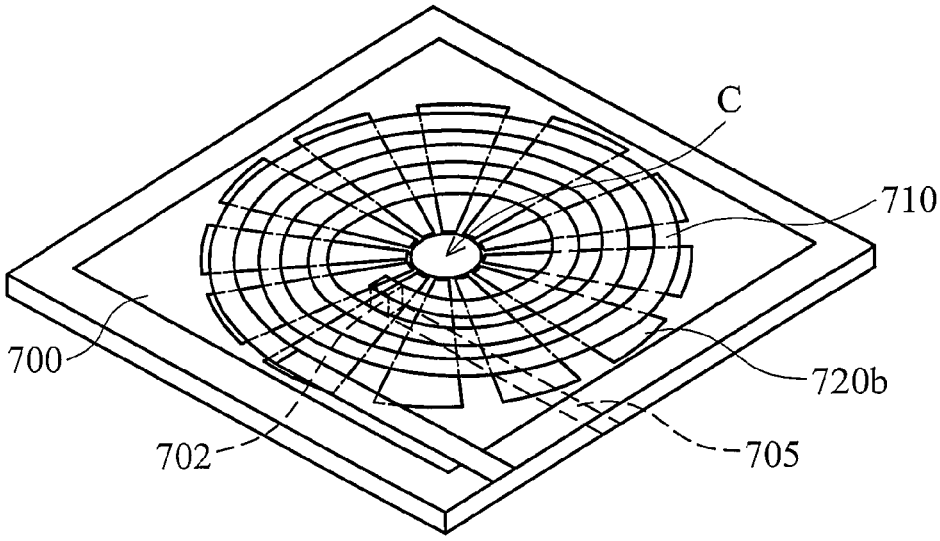
Figure 10C:
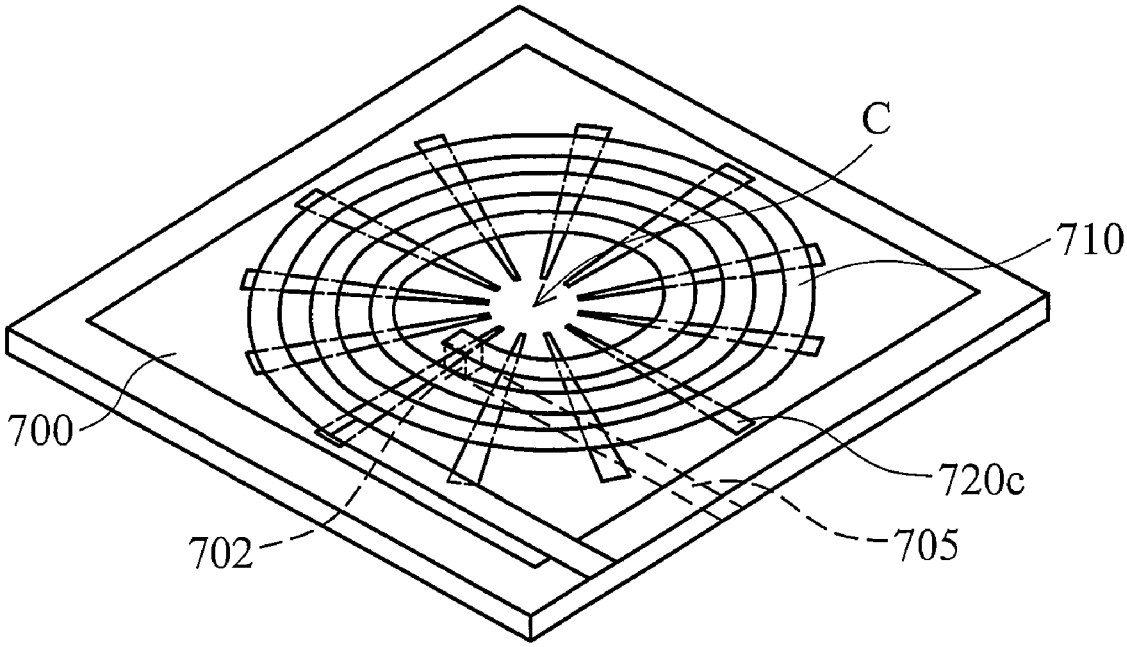

FIGS. 10A-10C are schematic views of another embodiment of embedded inductor devices of the invention. The structure and fabrication steps of the embedded inductor device of FIG. 10A are nearly identical to those of the embedded inductor device of FIG. 9 and for simplicity their detailed description are omitted. The embedded inductor device of FIG. 10A is different from the embedded inductor device of FIG. 9 in that the conductive coil 710 is a circular coil or an oval coil. The magnetic layer 720*a* with high permeability ($\mu_r$) is patterned into radiate strip shape such that the patterned magnetic layer 720*a* is substantially perpendicular to the conductive coil 710 at any crossover, thereby confining the induced magnetic flux along the patterned magnetic layer 720*a*.

Referring to FIG. 10B, the conductive coil 710 comprises a circular coil or an oval coil. The magnetic layer 720*b* with high permeability ($\mu_r$) is patterned into radiate wedge shape such that the patterned magnetic layer 720*b* is substantially perpendicular to the conductive coil 710 at any crossover. The central region C of the patterned magnetic layer 720*b* is a blank region. Alternatively, each of the radiate wedge shape of the patterned magnetic layer 720*b* extends to the central region C. For example, the conductive coil 710 is a circular coil. The winding of the conductive coil 710 is at least 3 turns. The patterned magnetic layer 720*b* is radiate wedge shape with intersect angle about 10°.

Referring to FIG. 10C, the patterned magnetic layer 720*c* is radiate wedge shape with intersect angle about 5°. Note that the inductance of the embedded inductor device of FIG. 10C increases from 3.05 nH to 3.38 nH, and the ratio of improvement is 11.4%. Moreover, the quality factor of the embedded inductor device of FIG. 10C increases from 103 to 127, and the ratio of improvement is 22.3%. Accordingly, reducing the line width and line interval of the patterned magnetic layer can significantly enhance inductance and quality factor of the embedded inductor device at high frequency application.

Although embodiments of the invention are described in conjunction with examples of embedded inductor devices with meander coil, rectangular coil and circular coil, which are not limited thereto, other geometric conductive coils such as polygonal planar coils and three dimensional coils are applicable thereto. Any patterned magnetic layer with high permeability ($\mu_r$) which is perpendicular to the conductive coil can significantly enhance quality factor of the embedded inductor at high frequency applications.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An embedded inductor device, comprising:

a substrate;

a conductive coil disposed on the substrate; and a patterned magnetic layer with high permeability disposed on the substrate, wherein the patterned magnetic layer physically contacts the conductive coil;

wherein the conductive coil and the patterned magnetic layer are intersected and substantially perpendicular to each other.

2. The embedded inductor device as claimed in claim 1, wherein the conductive coil perforates the substrate via a contact plug and connects a conductive layer on the back of the substrate, thereby generating a loop.

3. The embedded inductor device as claimed in claim 1, wherein the conductive coil perforates the substrate via a contact plug and connects a second conductive coil on the back of the substrate, thereby generating a loop.

4. The embedded inductor device as claimed in claim 1, wherein the conductive coil is squarely, circularly, or polygonally spiraled outwardly.

5. The embedded inductor device as claimed in claim 1, wherein the conductive coil is serpentinely winded perforating the substrate via a contact plug and connecting a second conductive coil on the back of the substrate, thereby generating a loop.

6. The embedded inductor device as claimed in claim 1, wherein the conductive coil comprises a plurality of conductive segments, each segment perforating the substrate via at least a contact plug and connecting a second conductive segment on the back of the substrate, thereby generating a loop.

7. The embedded inductor device as claimed in claim 1, wherein the patterned magnetic layer comprises a plurality of magnetic permeable lines, each permeable line substantially perpendicular to each other at any crossover with deviation less than ±10°.

8. The embedded inductor device as claimed in claim 7, wherein each of the magnetic permeable lines is connected with each other.

9. The embedded inductor device as claimed in claim 7, wherein each of the magnetic permeable lines is isolated from each other.

10. The embedded inductor device as claimed in claim 1, wherein the patterned magnetic layer comprises a plurality of magnetic permeable lines, each permeable line radiately extending outward, and wherein each of the magnetic permeable lines is connected with each other at a central area.

11. The embedded inductor device as claimed in claim 1, wherein the patterned magnetic layer comprises a plurality of magnetic permeable lines, each radiately extending outward, and wherein each of the magnetic permeable lines is isolated from each other at a central area.

12. The embedded inductor device as claimed in claim 1, wherein the patterned magnetic layer is disposed on the substrate, and the conductive coil is directly disposed on the patterned magnetic layer.

13. The embedded inductor device as claimed in claim 1, wherein the conductive coil is disposed on the substrate, and the patterned magnetic layer is directly disposed on the conductive coil.

14. The embedded inductor device as claimed in claim 3, further comprising a third patterned magnetic layer disposed on the back of the substrate, wherein the second conductive coil is directly disposed on the third patterned magnetic layer, and wherein the third patterned magnetic layer and the second conductive coil are substantially perpendicular to each other at any crossover.

15. The embedded inductor device as claimed in claim 3, wherein the second coil is disposed on the back of the substrate, and wherein the third patterned magnetic layer is directly disposed on the second conductive coil.

* * * * *